US005577626A

United States Patent [19]

Henkel et al.

[11] Patent Number: 5,577,626

[45] Date of Patent: Nov. 26, 1996

[54] CLOSURE WITH OPENING ASSIST FEATURE

[75] Inventors: James W. Henkel, Lombard, Ill.; Robert D. Rohr, Eagle, Wis.

[73] Assignee: AptarGroup, Inc., Crystal Lake, Ill.

[21] Appl. No.: 420,204

[22] Filed: Apr. 11, 1995

[51] Int. Cl.[6] ..... B65D 55/02

[52] U.S. Cl. ..... 215/237; 215/305; 220/326

[58] Field of Search ..... 215/216–225, 215/237, 235–242, 245, 280, 284, 304, 305, 396, 398, 399; 220/335, 339, 326, 771, 212.5

[56] References Cited

U.S. PATENT DOCUMENTS

| | | | |
|---|---|---|---|
| 3,581,928 | 6/1971 | Amand | 215/399 X |
| 4,002,275 | 1/1977 | Crowle et al. | 215/216 X |
| 4,420,089 | 12/1983 | Walker et al. | 215/216 |
| 4,787,526 | 11/1988 | Pehr | 215/216 |
| 4,852,770 | 8/1989 | Sledge et al. | 215/216 X |
| 4,925,041 | 5/1990 | Pehr | 215/216 |
| 5,137,260 | 8/1992 | Pehr | 215/216 |
| 5,143,234 | 9/1992 | Lohrman et al. | 215/216 X |
| 5,145,080 | 9/1992 | Imbery, Jr. | 215/216 X |
| 5,213,129 | 5/1993 | King et al. . | |
| 5,356,017 | 10/1994 | Rohr et al. | 215/216 |
| 5,358,129 | 10/1994 | Watts | 215/206 |
| 5,382,408 | 1/1995 | Perlman | 215/305 X |

OTHER PUBLICATIONS

Photographs A1, A2, A3, and A4 showing the front, side, top, and perspective views, respectively, of a closure provided by Shisheido Company of Japan.

Photographs B1, B2, B3, and B4 showing the front, side, top, and perpsective views, respectively, of a closure used on the Tylonol brand package.

*Primary Examiner*—Allan N. Shoap
*Assistant Examiner*—Nathan Newhouse
*Attorney, Agent, or Firm*—Dressler, Goldsmith, Milnamow & Katz, Ltd.

[57] ABSTRACT

A closure is provided for an opening to a container interior. The closure has a base for attachment to the container at the opening and defines a discharge aperture communicating with the opening. A lid is hingedly connected to the base for movement between a closed position occluding the aperture and an open position away from the aperture. A manually releasable latch is defined cooperatively by the base and lid to hold the lid closed. The lid has an outwardly projecting engaging member whereby the user can release the latch and apply a force to the member to lift the lid via the member.

12 Claims, 6 Drawing Sheets

Fig. 1
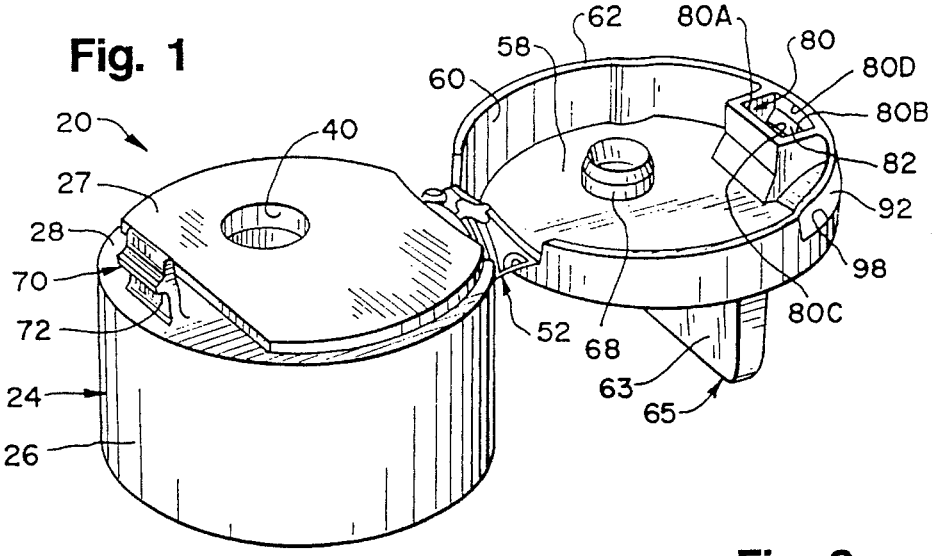
Fig. 2
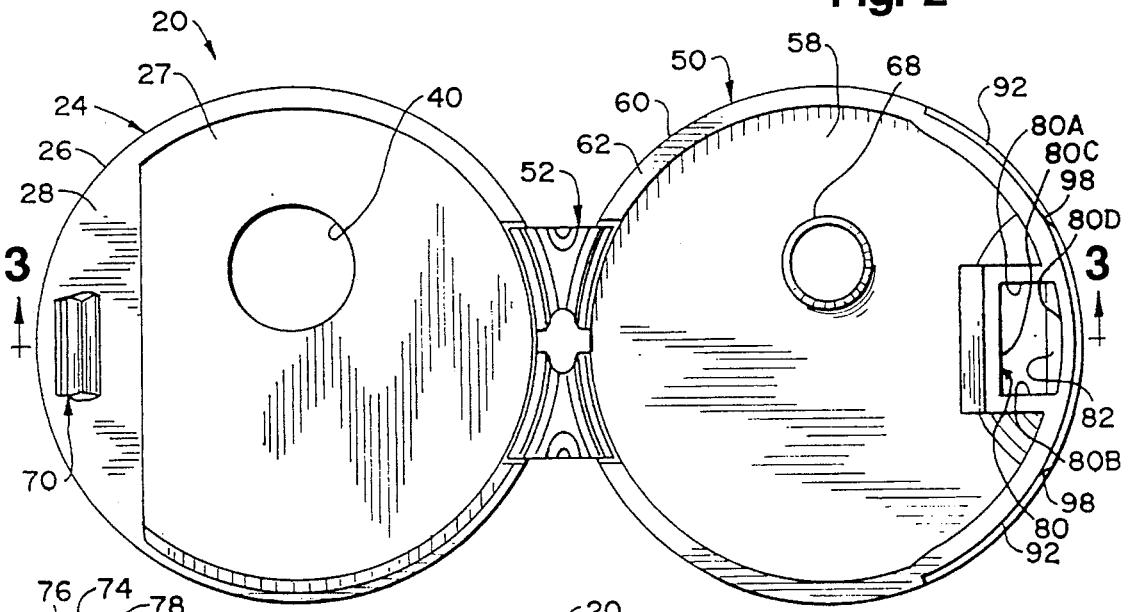
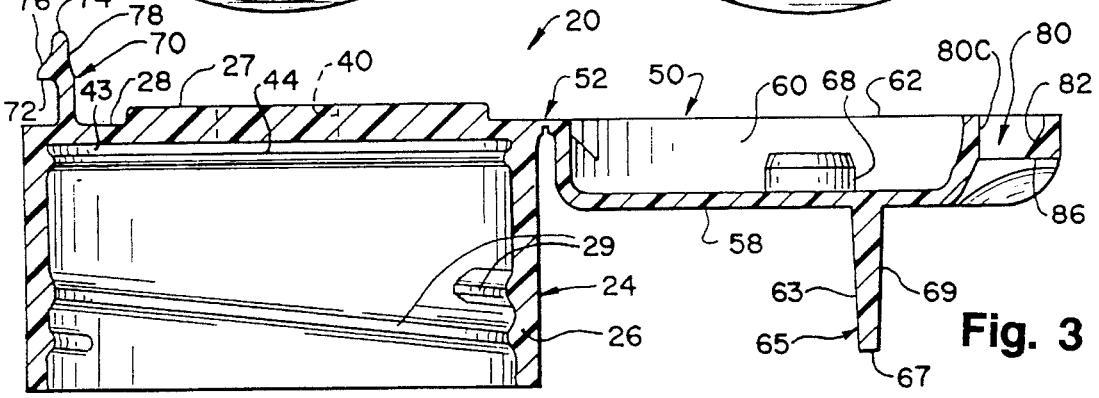
Fig. 3

Fig. 4
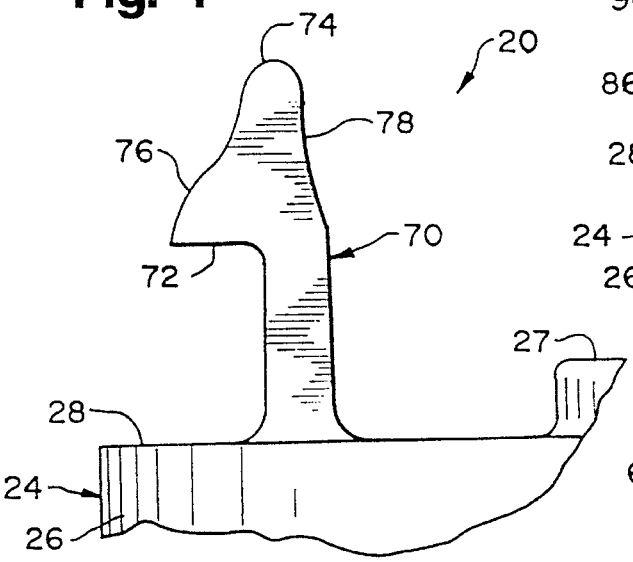
Fig. 6
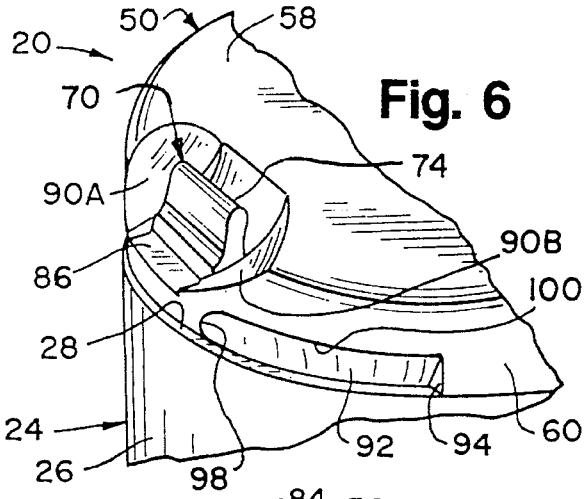
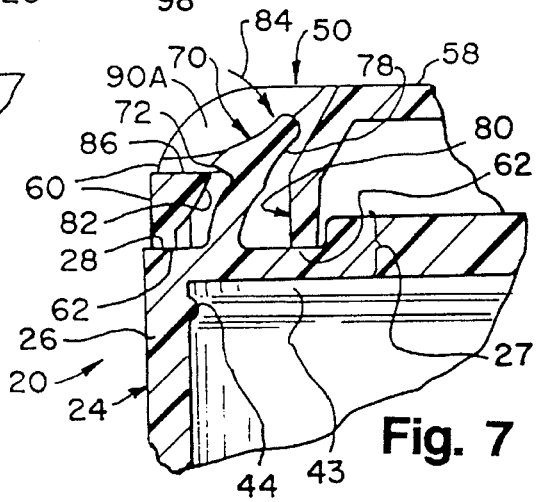
Fig. 7
Fig. 5
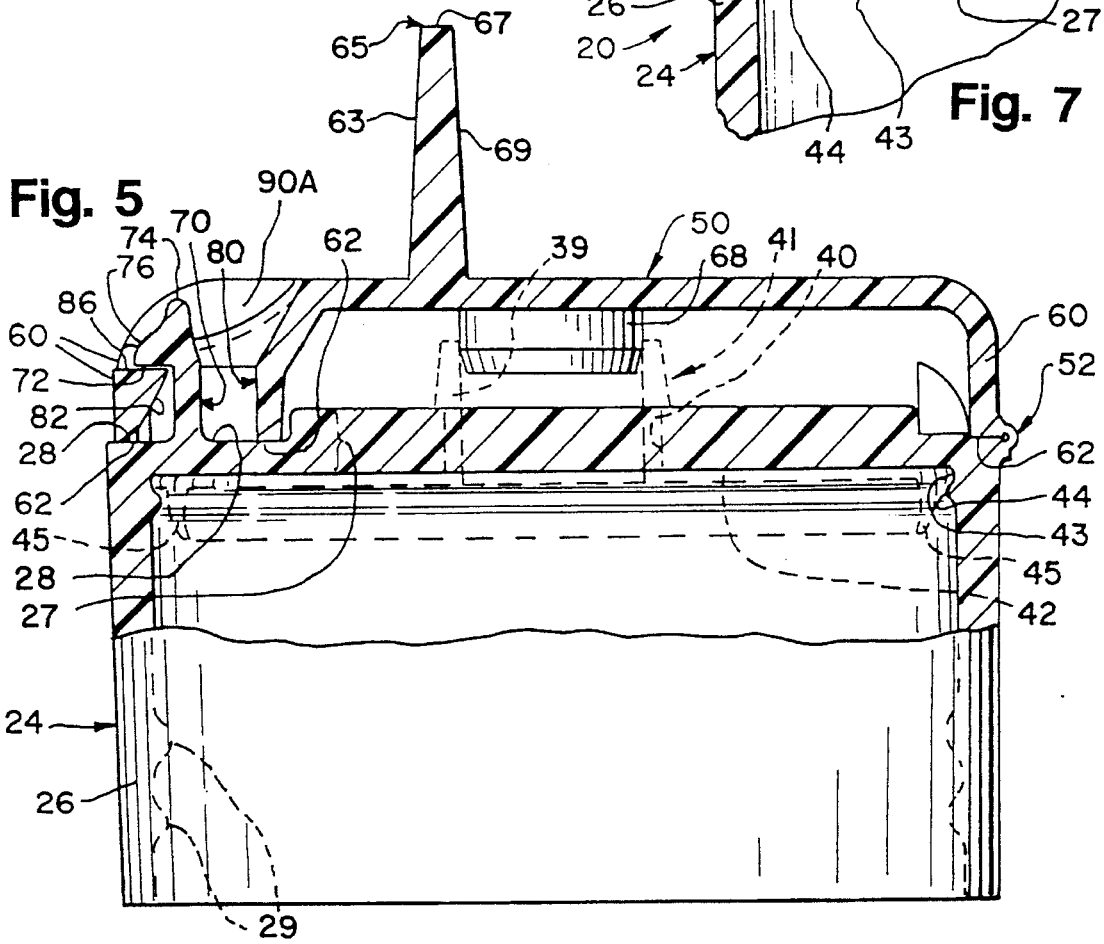

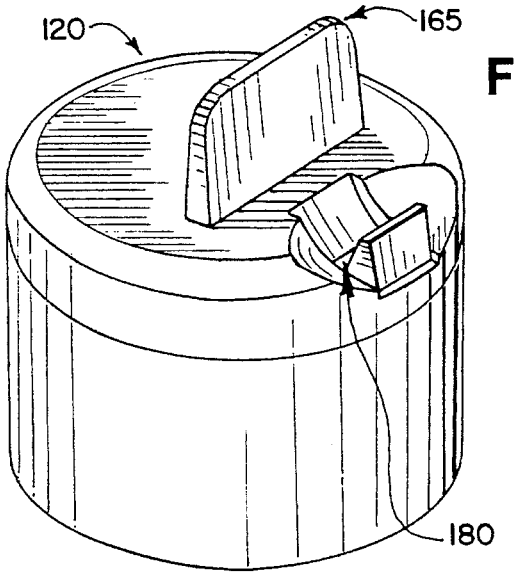
Fig. 8
Fig. 9
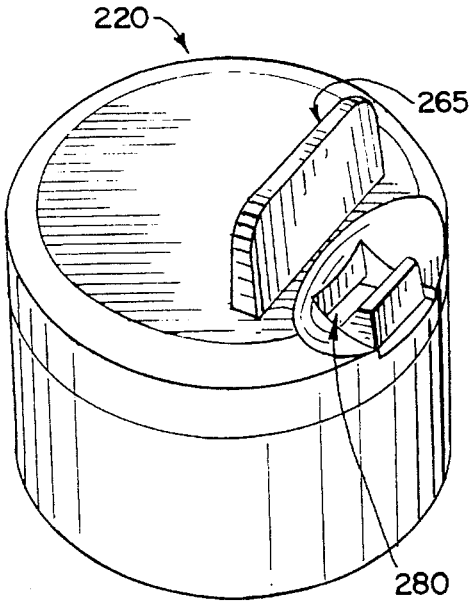
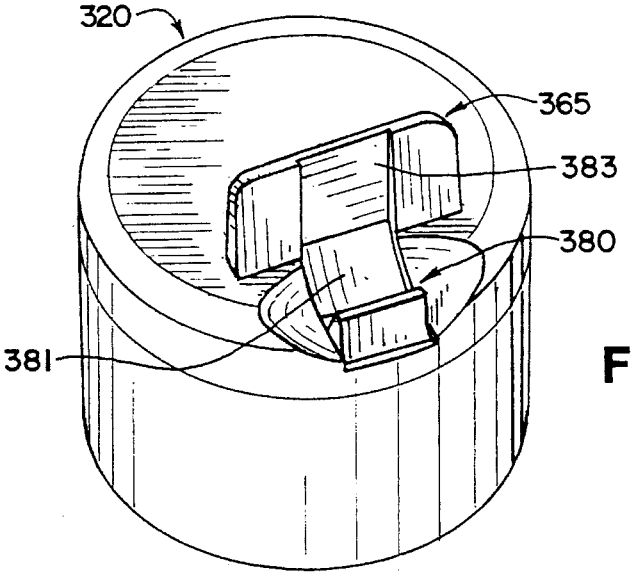
Fig. 10

CLOSURE WITH OPENING ASSIST FEATURE

TECHNICAL FIELD

This invention relates to a closure for a container with a hinged lid having an enhanced ease of opening for adult users and which is especially suitable for incorporation in child-resistant, dispensing closures.

BACKGROUND OF THE INVENTION AND TECHNICAL PROBLEMS POSED BY THE PRIOR ART

In the United States of America, manufacturers of child-resistant closures seek to provide closures that, under test protocols, meet or exceed the Consumer Products Safety Commission child-resistant safety standards.

A variety of closure designs are in use or have been proposed which provide some degree of child resistance. Typically, the designs incorporate elements or parts of the closure which must be manipulated in some way by the user with a sufficient amount of force in order to open the closure. Small children are typically unable to determine what manipulations are required to open the closure, and in any event, are typically not strong enough to effect the necessary manipulations with sufficient force. However, while such containers may be resistant to opening by a small child, such containers are also particularly difficult to open by some adult users, such as elderly adults, arthritic adults, and adults with other physical disabilities or limitations.

Accordingly, it would be desirable to provide an improved, one-piece closure having a hinged lid which can be more easily opened by an adult user.

It would also be advantageous if such an improved closure could also be readily incorporated in a closure of the child-resistant type.

Further, it would be beneficial if such an improved closure could maintain a secure and latched closed condition, but yet could be opened by an adult without the need of a tool or other special device.

It would also be beneficial if such an improved closure could be provided in the form that would not require excessively complicated manufacturing operations and that would permit the use of conventional, high-speed, automatic capping machines for applying such closures to containers.

The present invention can be embodied in designs that provide one or more of the above-discussed benefits and features.

SUMMARY OF THE INVENTION

The present invention provides a hinged lid closure that can be more easily opened by an adult, even an adult with some diminished manipulative capabilities. The invention may be included in a dispensing closure offering advantages of greater aesthetic appeal, child resistance, easier manufacturing, and better compatibility with high-speed, automatic capping machines.

The closure is intended for mounting on a container at an opening to the container interior. The closure includes a base for attachment to the container at the opening. The base defines a discharge aperture communicating with the container opening.

The closure includes a lid hingedly connected to the base for movement between a closed position occluding the aperture and an open position away from the aperture.

A manually releasable latch is defined cooperatively by the base and lid to hold the lid closed.

The lid has an outwardly projecting engaging member. The user can release the latch and apply a force to the member to move the lid toward the open position via the engaging member.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same, FIG. 1 is a perspective view of the closure of the present invention shown in a fully open, as molded, dispensing orientation;

FIG. 2 is an enlarged plan view of the closure;

FIG. 3 is a cross-sectional view taken generally along the plane 3—3 in FIG. 2;

FIG. 4 is a greatly enlarged, fragmentary, side elevational view of the locking lever of the closure base;

FIG. 5 is an enlarged, side elevational view, taken partly in cross section, of the closure in the locked closed orientation;

FIG. 6 is a fragmentary, perspective view of the front of the closure showing the latching and opening features;

FIG. 7 is a fragmentary view similar to FIG. 5 showing the locking lever in a temporarily deflected position to permit opening of the closure lid;

FIG. 8 is a perspective view of a second embodiment of the closure of the present invention;

FIG. 9 is a perspective view of a third embodiment of the closure of the present invention;

FIG. 10 is a perspective view of a fourth embodiment of the closure of the present invention;

FIG. 12 shows a range of locations and heights of the engaging member;

DESCRIPTION OF THE PREFERRED EMBODIMENTS

Figure 11:
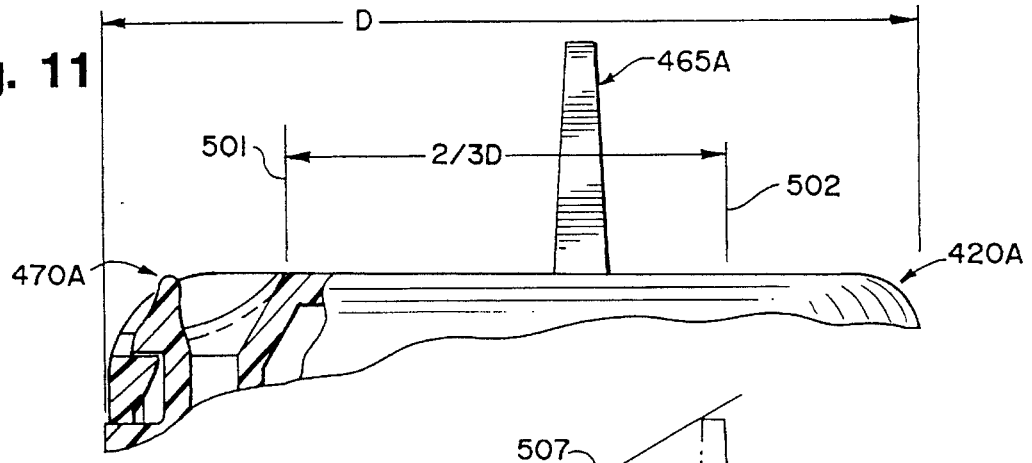
FIG. 11 is a side elevational view, partially in cross section, of a fifth embodiment of the closure of the present invention.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in an upright position, and terms such as upper, lower, horizontal, etc., are used with reference to this position. It will be understood, however, that the closure of this invention may be manufactured, stored, transported, used, and sold in an orientation other than the position described.

FIG. 1 shows an embodiment of the invention as incorporated in one specific type of child-resistant, dispensing closure in a fully opened, as molded, dispensing orientation wherein the closure is represented generally by reference number 20. The closure 20 is adapted to be mounted on a container (not illustrated) which may have a conventional open mouth defined by a neck (not illustrated) or other suitable structure.

The closure 20 includes a closure base or body 24 for securement to the container. The base 24 includes a generally cylindrical, peripheral wall 26 and a generally transverse closure wall or deck 28 (FIGS. 1–4 and 5) which extends across the base 24. A central portion 27 of the base deck 28 is thicker so that the surrounding portion of the deck 28 defines a peripheral shoulder.

The cylindrical wall 26 of the closure base 24 is adapted to engage the outer periphery of the top of the container neck (not illustrated) around the container mouth, as with threads 29 (FIG. 3) which may include an appropriate conventional or special structure for preventing removal of the installed closure. Other suitable engaging means (e.g., snap-fit beads) may be provided to secure the closure base 24 on the container. Alternatively, in some applications the closure base 24 could be non-releasably attached to, or formed unitary with, the container.

The closure base 24 includes a discharge passage 40 through the deck 28 as best illustrated in FIGS. 1, 2, and 5. In a presently contemplated product, the closure passage 40 may be optionally oversized to accommodate the hollow discharge tube 39 of an insert member 41 (shown in phantom with dashed lines only in FIG. 5). The tube 39 projects upwardly through the passage 40 from a flange 42 which is disposed under the body deck 28 and secured thereto in a groove 43 defined by a bead 44 on the inside of the body skirt 26 below the deck 28. The insert 41 also includes a downwardly projecting, conventional, sealing ring 45 for engaging an interior edge of the container neck at the container mouth to effect a tight seal. The use of such an insert 41 is an optional design feature of a closure. The optional insert feature forms no part of the present invention.

A lid 50 is hingedly connected by a hinge means or hinge 52 to the edge of the base 24. The lid 50 is adapted to be pivoted between (1) a closed position (FIG. 5) preventing flow of the container-stored contents through the closure and (2) an open position (FIGS. 1–3) moved away from the closed position permitting the dispensing of the container-stored contents from the base discharge aperture.

The lid 50 is shown in FIGS. 1–3 in a fully opened, as molded, position. However, it will be appreciated that the lid 50 need not be moved to the completely open position in order to permit access to the container interior and the dispensing of the container contents.

In the preferred embodiment illustrated, the hinge 52 is a snap-action hinge of the conventional type described in the U.S. Pat. No. 4,403,712. It is not required that the hinge 52 be a snap-action type hinge. Any suitable hinge system may be employed for connecting the lid 50 to the base 24 consistent with the particular application requirements, aesthetics, manufacturing techniques, etc.

Preferably the lid 50 and the closure body 24 are molded as a unitary structure from suitable thermoplastic materials, such as polypropylene or polyethylene. However, the lid 50 and body 24 could be formed as separate pieces for subsequent assembly with a suitable connecting hinge system to permit opening and closing of the lid. The detailed design and operation of the hinge per se form no part of the present invention.

The lid 50 preferably includes a central cover panel 58 and has a peripheral skirt 60 depending from the periphery of the central cover panel 58. The lid skirt 60 (FIGS. 1–3) has a bottom surface 62 defining a bottom surface of the lid. The skirt bottom surface 62 is adapted to rest on the peripheral, annular shoulder of the base deck 28 when the lid is closed as illustrated in FIG. 5.

In the illustrated embodiment, the lid 50 also includes a sealing spud or member 68 (FIGS. 1–3 and 5) which projects from the central cover panel 58. The sealing member 68 is adapted to enter into the discharge opening of the hollow tube 39 projecting upwardly through base central deck region 27 when the lid 50 is closed (FIG. 5). This is particularly suitable for use with containers of liquids.

It will be appreciated, however, that the base discharge tube 39 and lid sealing member 68 need not be provided in the form illustrated, or need not be provided at all. If the closure 20 is used with liquids, then other means for sealing the closure lid 50 and base 24, as around the lid skirt bottom surface 62, may be employed. If the closure 20 is designed for a container for pills or other individual items, then a major portion of the base deck central portion 27 may be eliminated in order to provide a relatively large access opening to the container. In such a case, the discharge tube 39 and lid sealing member 68 would, of course, be eliminated.

According to one aspect of the invention, the lid 50 includes an outwardly projecting engaging member 65. In the preferred form illustrated in FIGS. 1–7, the engaging member is a generally planar tab or flange extending generally perpendicularly outwardly from the upper surface of the closure lid cover panel 58. The member 65 includes a front engaging surface 63, a distal end or top edge 67, and a rear engaging surface 69. In the preferred embodiment, wherein the closure is generally cylindrical, at least part of the front engaging surface 63 is substantially parallel with the closure longitudinal axis.

During the opening of the lid, the engaging member 65 may be pushed, pulled, grasped, or otherwise manipulated in a manner that will assist in tilting the closure lid 50 upwardly to the open position.

In the preferred form, the engaging member 65 is incorporated in a closure having a latching mechanism (described in detail hereinafter), and the lid 50 cannot be lifted upwardly with the engaging member 65 until the latching mechanism is released.

When the engaging member 65 is provided in a child-resistant closure with a child-resistant latching mechanism, the engaging member 65 has a shape on the lid and a position on the lid which make it difficult for a small child to both properly manipulate the latching mechanism and properly manipulate the engaging member as necessary to open the closure. Further, the shape and location of the engaging member 65 are preferably such that they inhibit a small child's access to at least part of the latching mechanism. In particular, the engaging member 65 can be designed to make it more difficult, if not impossible, for a small child to put his mouth over the top of the closure and engage the latching mechanism with his teeth. The engaging member 65 can also be designed to make it more difficult for the small child to place his fingers or hand in the area between the engaging member and the latching mechanism.

The latching mechanism, which will now be described in detail, is provided for maintaining the lid 50 in the closed position and inhibiting a child from opening the closure. In the preferred embodiment, the base 26 has, at the front of the closure 20 diametrically opposite from the hinge 52, a resilient locking lever 70 which projects upwardly from the base deck 28 at a location inwardly of the periphery of the base. The locking lever 70 has an outwardly extending, and downwardly facing, shoulder 72. The lever 70 is relative stiff, and a small child would find it difficult, if not impossible, to use a finger to bend or deflect the locking lever 70 rearwardly toward the hinge 52.

The top of the locking member 70 has a curved distal end 74, and the front region of the locking member 70 above the shoulder 72 extends outwardly, in a slightly convex curve, from the thinner distal end to the outer edge of the shoulder 72. This defines a camming surface 76 against which the lid 50 acts as explained hereinafter. The lever 70 also has an inwardly concave, upper, rear surface 78 (FIG. 4) which provides clearance when the lever 70 is deflected rearwardly as described hereinafter.

The lid central cover panel 58 defines an aperture, slot, or hole 80 (FIGS. 1–3) inwardly of the periphery of the lid for receiving the lever 70 when the lid is closed (FIG. 5). The bottom of the aperture 80 opens at the bottom surface of the lid (i.e., lid skirt bottom surface 62).

The hole 80 has four sides. As can be seen in FIGS. 1 and 2, the hole 80 has two opposed, planar, end walls 80A and 80B and a planar, rear wall 80C which is perpendicular to the end walls 80A and 80B. The aperture 80 also has a curved lower front wall 80D which rises a short distance from the lid skirt bottom surface 62.

At the top of the lower front wall 80D, the hole 80 becomes narrower owing to an inwardly slanting, planar, upper front wall 82. The surface 82 acts as a camming surface for engaging the lever camming surface 76 as the lid 50 is pivoted downwardly to the fully closed position. As the camming surfaces 82 and 76 engage, the lever 70 is deflected rearwardly, in the direction of the arrow 84 as shown in FIG. 7, to accommodate movement of the lid 50 to the fully closed position wherein the lid skirt seating surface 62 engages the base deck 28. As the lever 70 bends rearwardly, clearance is enhanced by the concave rear surface 78 on the back of the lever 70.

The lid camming surface 82 terminates at a horizontally disposed latch surface 86 at an elevation slightly below the elevation of the downwardly facing shoulder 72 on the lever 70. Thus, when the lid 50 is fully seated in the closed position, the lever 70 returns to its normal, undeflected position owing to the inherent resiliency of the lever material. When the locking lever 70 has returned to the normal, unstressed position illustrated in FIG. 5, the locking lever shoulder 72 overlies the lid latch surface 86 and prevents the lid 50 from being pivoted upwardly unless the locking lever 70 is first pivoted rearwardly.

When the lid 50 is fully closed as illustrated in FIG. 5, the top surface of the lid on either lateral side of the lever 70 is at an elevation slightly greater than the top of the lever distal end 74. The clearance around the top of the lever 70, and the overall width of the lever 70, are relatively small. This reduces the exposure of the lever 70 to engagement with a child's teeth and inhibits efforts of a child to bend the lever 70 rearwardly. Further, the small clearance around the lever 70 inhibits the insertion of a child's teeth under the lever shoulder 72. The possibility that a small child could get his mouth or teeth around the lever 70 is further minimized by the engaging member 65.

However, in order to facilitate opening of the closure by an adult user, the lid 50 defines a finger access recess around, and extending from the aperture, and the recess is defined in part by two, spaced-apart, concave, curved surfaces 90A and 90B (FIG. 6). The surfaces 90A and 90B accommodate the width of a typical adult finger so that an adult can position a finger adjacent the upper front portion of the locking lever 70 and push the locking lever 70 rearwardly. However, the overall extent of the depth and width of the adjacent surfaces 90A and 90B are relatively small so as to reduce the exposure of the lever 70 to engagement with a child's teeth and so as to inhibit efforts of a child to bend the lever 70 rearwardly.

Further, as illustrated in FIG. 5, the top of the locking lever distal end 74 is preferably recessed slightly below the top of the adjacent central cover panel 58 of the lid. Further, as can be seen in FIG. 5, the peripheral region of the lid 50, including the skirt 60, extends outwardly beyond the front of the locking lever 70 to prevent a child's teeth from engaging the front of the lever 70.

The adult user can open the closure by pushing the lever 70 rearwardly and then lifting up on, or pushing against, the engaging member 65. The engaging member 65 may be grasped between the thumb and finger of one hand and lifted upwardly while the fingers of the other hand are used to hold the closure and push the lever 70 rearwardly.

Alternatively, the adult user, having a finger much longer than a small child's finger, may hold the closure base or container with one hand, and then with the other hand position a finger downwardly from above the engaging member 65 so as to engage the member top edge 67 while pulling back on the lever 70 with the end of the finger. In this manner, the adult can open the lid with one hand while holding the closure base or container with the other hand. However, a small child would not have long enough fingers to open the lid with one finger in this manner.

Further, a small child would not have the intelligence or manual dexterity sufficient to push the lever 70 rearwardly. Of course, the engaging member 65 also inhibits the ability of the small child to get his mouth and teeth near the lever 70 in a way that would permit the teeth to easily engage the lever and move it rearwardly.

While the adult user who is arthritic or has other physical limitations will find it convenient to use the engaging member 65, it will be appreciated that other adult users need not necessarily use the engaging member 65. Indeed, the closure includes other features which can assist the adult user in lifting the lid upwardly in an alternate, different manner than has been described above. In particular, the lid 50 may also include a pair of spaced-apart, finger-engaging surfaces 92 (FIGS. 2 and 6). The finger-engaging surfaces 92 are defined in the skirt lid 60 by spaced-apart, shallow indentations on either side of the latch area. The indentations are each laterally offset relative to the lid hole 80. Each indentation is defined at one end by an inwardly extending surface 94 (FIG. 6), and each finger-engaging surface 92 forms an outwardly facing, smooth wall defining a rear portion of the indentation.

Preferably, each indentation and associated finger-engaging surface 92 extends completely to the skirt bottom surface 62 but terminates short of the top of the skirt. Further, the end of each finger-engaging surface 92 opposite the indentation end wall 94 merges with the lid skirt 60, as at 98 (FIG. 6).

In order to permit the adult user's finger to exert an upper, opening force on the periphery of the lid 50, each finger-engaging surface 92 extends progressively outwardly with increasing distance from the lid bottom surface 62 as can be seen in FIG. 6. The finger-engaging surface 92 terminates along a top edge 100 (FIG. 6) which extends forwardly or outwardly of the lid skirt bottom edge. However, the finger-engaging surface 92 is free of overhanging peripheral surfaces of a depth sufficient to be liftingly engaged by a child's teeth. That is, the indentation is sufficiently shallow and slopped or curved so that the child's upper or lower front teeth cannot effectively engage, in a non-slipping manner, the surface 92 and apply sufficient force in the direction needed to pry the lid 50 away from the base 24.

Further, the other portions of the lip periphery between the two finger-engaging surfaces 92 and between each surface 92 and the hinge 52 are free of overhanging peripheral surfaces of sufficient depth to be liftingly engaged by a child's teeth.

In order to increase the child resistance of the closure 20, the finger-engaging recesses 92 do not extend in front of the region of the locking lever 70. That is, the lift area presented by each finger-engaging surface 92 is laterally displaced from the locking lever 70 and aperture 80 by an amount sufficient to require the user to perform the opening manipulations at two distinctly different locations on the closure in order to open the lid. Thus, the locking lever 70 must be engaged at one location on the lid 50, and while the locking lever is deflected, the lid 50 must be opened by lifting at one or both of the separated, laterally displaced, finger-engaging surfaces 92 (or alternatively, by applying a lifting force to the lid-engaging member 65 as described above in detail). This manipulation sequence is difficult and confusing for small children.

Preferably, the surface of skirt 60 immediately below the latch surface 86 between the finger-engaging surfaces 92 is substantially vertical and smooth, and is somewhat forward of the locking lever shoulder 72, so as to eliminate or reduce the presence of surfaces or edges that could be engaged by a child's teeth to separate or distort the structures in the region of the locking lever 70.

In addition, the portion of the base 24 that extends from the hinge 52 is configured to project peripherally outwardly at least as far as the lid bottom surface 62. Preferably, the base 24 extends peripherally outwardly further than the lid skirt bottom surface 62 as illustrated in FIG. 5. Because the base 24 normally projects beyond the closed lid 50, the closure has a larger range of manufacturing (molding) tolerances. That is, the molding of a slightly larger lid would still not result in the lid projecting peripherally beyond the base 24 so as to create an overhanging ledge that could be engaged by a child's teeth. Thus, the closure has the capability for more easily accommodating manufacturing processes.

Further, the closure can be molded with substantially no significant radial projections. Thus, the closure can be readily applied to a container with a conventional high-speed, automatic capping machine.

FIG. 8 illustrates a second embodiment of the closure designated generally by the reference number 120, FIG. 9 illustrates a third embodiment of the closure designated generally by the reference number 220, and FIG. 10 illustrates a fourth embodiment of the closure designated generally by the reference number 320. As shown in FIG. 8, the closure 120 includes a lid-engaging member 165 spaced somewhat behind a latch hole 180 which has a slightly different configuration in the lid compared to the latch hole 80 in the first embodiment lid 50 described above with reference to FIGS. 1–7.

In the third embodiment of the closure 220 shown in FIG. 9, the closure lid includes an engaging member 265 which is closer to a lid hole 280, and the lid hole 280 has a somewhat different configuration at the surface of the lid compared to the surface configuration of the hole 80 of the closure first embodiment described above with reference to FIGS. 1–7.

In the fourth embodiment illustrated in FIG. 10, the closure 320 has a lid hole 380 with yet a different configuration at the surface of the lid, including a rearwardly extending surface 381 which slopes upwardly and merges with a recessed surface 383 in the engaging member 365.

A fifth embodiment of the closure 420A is shown in FIG. 11. The closure lid includes an engaging member 465A which is located somewhat further away from the closure locking lever 470A compared with the distance between the locking lever and engaging member in the embodiments previously described with reference to FIGS. 1–10.

The engaging member 465A may be located on the top of the closure in a range of distances from the locking lever 470A. A preferred range of locations is illustrated in FIG. 11 by the vertical line 501 which marks the end of the range closest to the locking lever 470A and by the vertical line 502 which marks the preferred range end furthest from the locking lever 470A.

In the preferred embodiment illustrated in FIG. 11, the lines 501 and 502 define a range or distance which is preferably two thirds of the closure diameter D, and this range is centered relative to the closure diameter and is oriented on a line perpendicular to the locking lever 470A. The minimum distance that the engaging member 465A would be located away from the diametrical edge of the closure 420A is preferably determined by dividing the lid diameter in inches by twelve (i.e., D/12).

Figure 12:
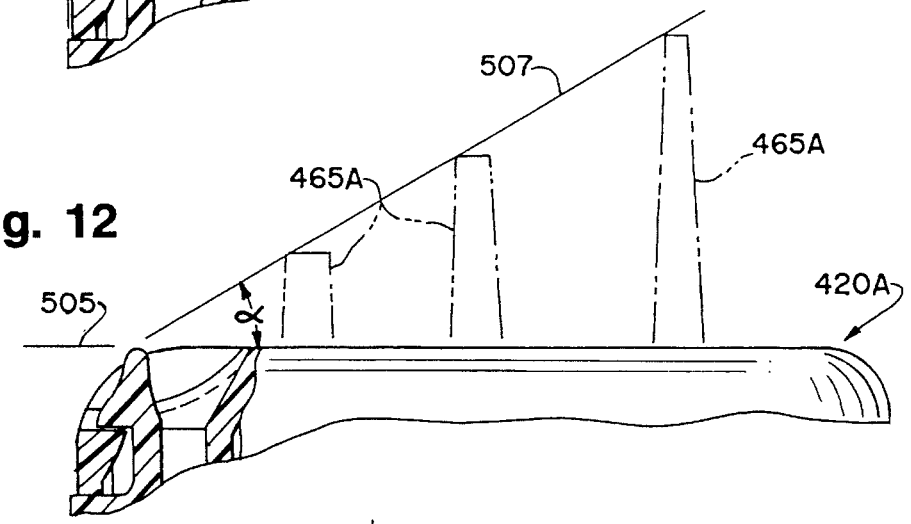
FIG. 12 is a view similar to FIG. 11.

FIG. 12 illustrates a preferred relationship between the height of the engaging member 465A and the location of the engaging member 465A. As the engaging 465A is located closer to the locking lever 470A, the height of the engaging member 465A decreases. As the engaging member 465A is located further from the locking member 470A, the engaging member 465A increases in height. In one preferred relationship, a line 505 parallel to the closure lid top is tangent to the top of the locking lever 470A. A second line 507 is oriented at an angle α relative to the first line 505. The second line 507 intersects the first line 505 and is tangent to the top of the locking lever 470A. The engaging member 465A would have a height determined by the line 507.

The purpose of providing a shorter engaging member 465A nearer the locking lever 470A is to keep the mechanical advantage approximately the same with respect to the opening force which can be applied by pushing on the engaging member 465A. When the engaging member 465A is located further from the locking lever 470A, and hence closer to the lid hinge (e.g., hinge 52 in FIG. 1), the force required to pivot the lid open will be greater. Thus, a taller engaging member 465A is employed. On the other hand, when the engaging member 465A is further away from the lid hinge and hence closer to the locking lever 470A, then there is a longer pivot arm, and the engaging member 465A must be shorter so as to prevent the user from exerting an excessive amount of force on the lid.

It will be appreciated that the closure, when made from thermoplastic materials, can be subjected to the application of relatively large forces by a child attempting to open the closure. These large forces, unless limited in some way, might tend to temporarily or permanently deform the thermoplastic material where the locking lever is engaged with the closure lid. This could lead to the lid becoming disengaged from the locking lever even without the lever being pushed rearwardly as intended during the normal opening operation. However, if the engaging member 465A is made short enough relative to its location on the closure lid, then it will be not possible for a small child, or even an adult, to apply enough force to the engaging member 465A to effect a deformation of the thermoplastic material at the locking lever latch. Thus, the closure can then only be opened by the more complex operation of simultaneously pushing the locking lever rearwardly while forcing the lid upwardly (as by pushing upwardly or pulling upwardly on the engaging member 465A).

Figure 13:
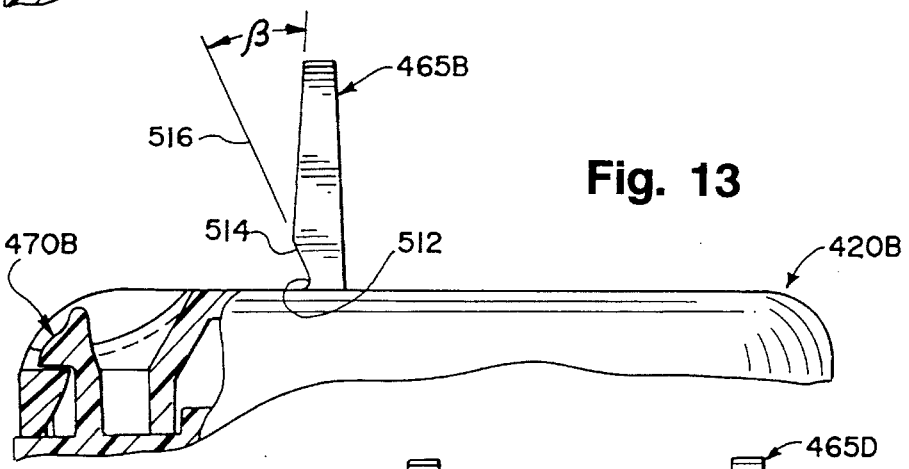
FIG. 13 is a view similar to FIG. 11, but FIG. 13 shows a sixth embodiment of the closure of the present invention.

FIG. 13 illustrates another embodiment of the closure 420B wherein the amount of force that can be effectively applied to the engaging member 465B is limited so as to prevent the unintended deformation, and hence potential disengagement, of the thermoplastic material at the latch region defined by the locking lever 470B and the adjacent lid portion. The engaging member 465B has a notch at the front of the member adjacent the top of the lid. The notch is defined by a radius 512 and a tangent surface 514. The tangent surface may have an angle β as defined between the front, planar surface of the engaging surface 465B and an imaginary continuation of the tangent surface 514 illustrated by the line 516.

When excessive force is applied to the engaging member 465B, it will bend. This prevents the transfer of high forces and moments to the region of the latching member 475A which might otherwise cause a deformation, and hence a release, of the engaged thermoplastic materials defining the locking lever 470A and the adjacent, latched lid region.

Figure 14:
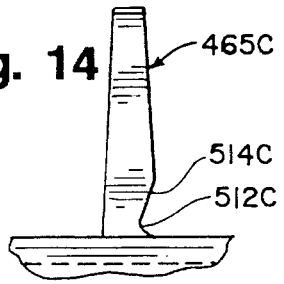
FIG. 14 is a view similar to FIG. 13, but FIG. 14 shows a seventh embodiment of the closure of the present invention.

FIG. 14 illustrates how a similar notch defined by a radius 512C and a tangent surface 514C may be provided on the rear side of an engaging member 465C.

Figure 15:
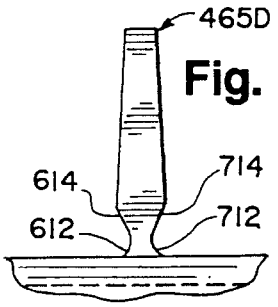
FIG. 15 is a view similar to FIG. 14, but FIG. 15 shows an eighth embodiment of the closure of the present invention.

FIG. 15 illustrates an engaging member 465D having a front notch defined by a radius 612 and tangent surface 614 and having a rear notch defined by a radius 712 and tangent surface 714.

The engaging members 465C and 465D would bend or flex when excessive force is applied. This would prevent the transfer of high forces and moments to the locking lever region that might otherwise be sufficient to cause a deformation of the thermoplastic material and release or disengagement of the latch locking lever.

Figure 16:
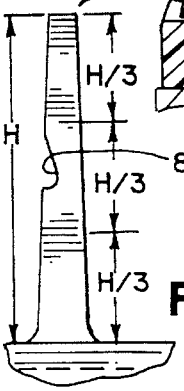
FIG. 16 is a view similar to FIG. 15, but FIG. 16 shows a ninth embodiment of the closure of the present invention.

FIG. 16 illustrates an engaging member 465E which has a notch 812 defined in the front surface of the engaging member 465E. In a preferred embodiment, the height H of the member 465E can be divided into thirds (each having a length of H/3), and the notch 812 is located in the middle one third of the member height. The member 465E will bend when excessive force is applied, and thus will prevent transfer of forces and moments to the locking lever 470E which would otherwise create deformation of the thermoplastic material and release of the lever.

Figure 17:
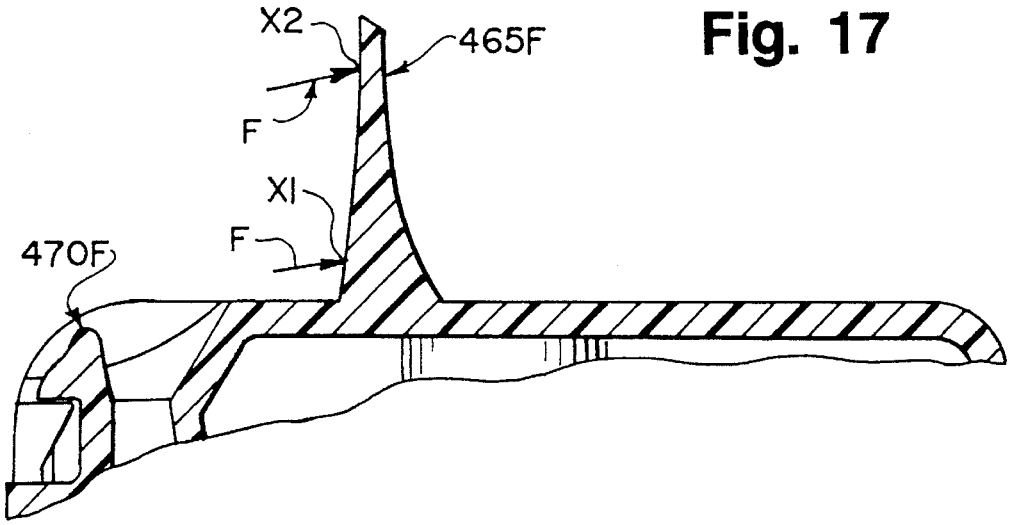
FIG. 17 is a view similar to FIG. 11, but FIG. 17 shows a tenth embodiment of the closure of the present invention.

FIG. 17 illustrates an embodiment of a closure 420F which has an engaging member 465F that is thicker on the bottom and which becomes progressively thinner towards the top. In one contemplated preferred embodiment, the thickest section of the member 465F at the surface of the lid would be about 0.115 inch. The change in thickness (i.e., the decrease in thickness) with the increasing height of the member 465F provides an increasingly flexible system. This allows the top of the member 465F to be grasped or pushed to help lift the closure lid open if the locking lever 470F is properly pushed rearwardly to release the latch. However, if the locking member 470F is not pushed rearwardly to release the latch, then the engaging member 465F will bend when excessive force is applied. If a force F is applied to the engaging member 465F near the bottom (at location X1 in FIG. 17), then the locking lever 470F is subjected to a transferred deformation load that is less than if the same force F were applied at the top of the engaging member 465F (at location X2 in FIG. 17). Consequently, the engaging member 465F is thinnest at the top so as to bend when subjected to a high force F and prevent transfer of excessive loads to the locking lever 470F.

Figure 18:
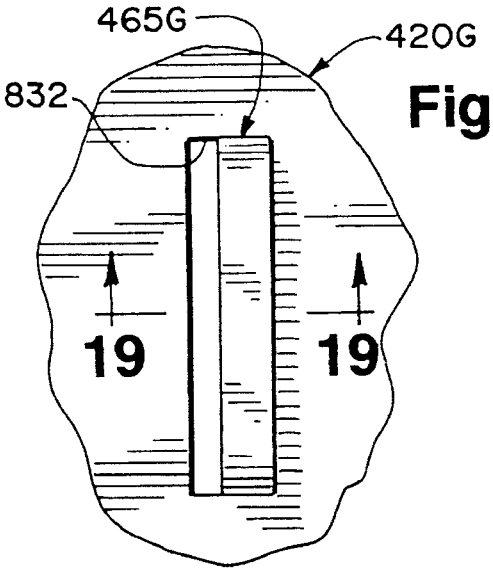
FIG. 18 is a fragmentary, top plan view of an eleventh embodiment of the closure of the present invention.
Figure 19:
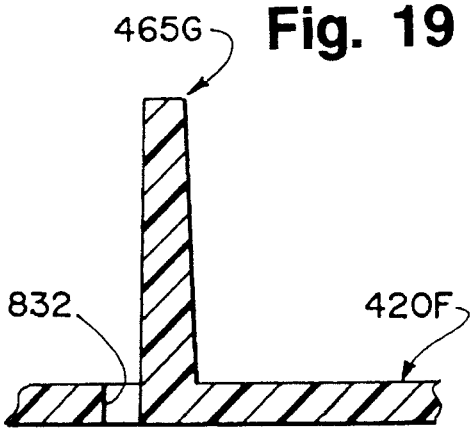
FIG. 19 is a fragmentary, cross-sectional view taken generally along the plane 19—19 in FIG. 18.

FIGS. 18 and 19 show the top of a closure 420G which has an engaging member 465G projecting upwardly from the closure lid adjacent a space, gap, or channel 832. The channel 832 reduces the rigidity of the system, and this permits the engaging member 465G to bend if excessive forces are applied.

Figure 20:
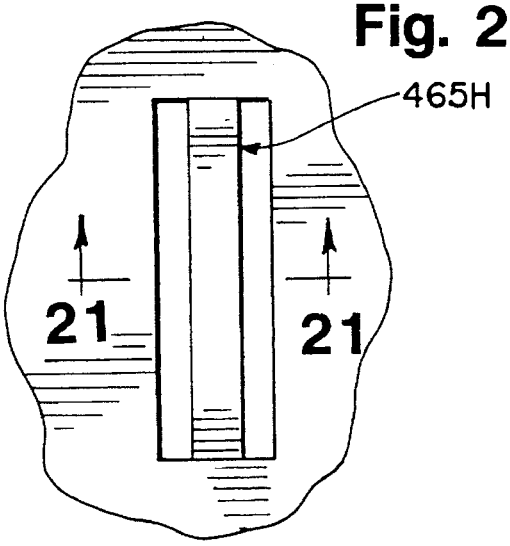
FIG. 20 is a view similar to FIG. 18, but FIG. 20 shows a twelfth embodiment of the closure of the present invention.
Figure 21:
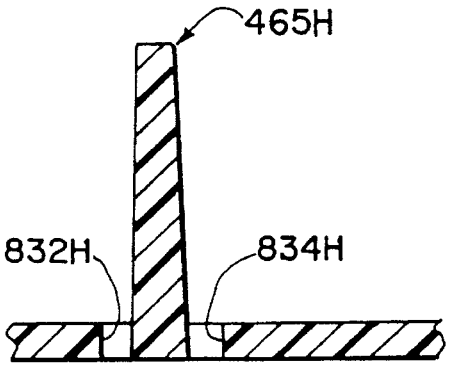
FIG. 21 is a fragmentary, cross-sectional view taken generally along the plan 21—21 in FIG. 20.

FIGS. 20 and 21 illustrate an engaging member 465H which extends upwardly from the closure lid between a pair of spaces or channels 832H and 834H. The engaging member 465H is connected to the closure lid only at opposite ends, and this is a highly flexible system which prevents the transfer of excessive moments and forces to the locking lever.

Figure 22:
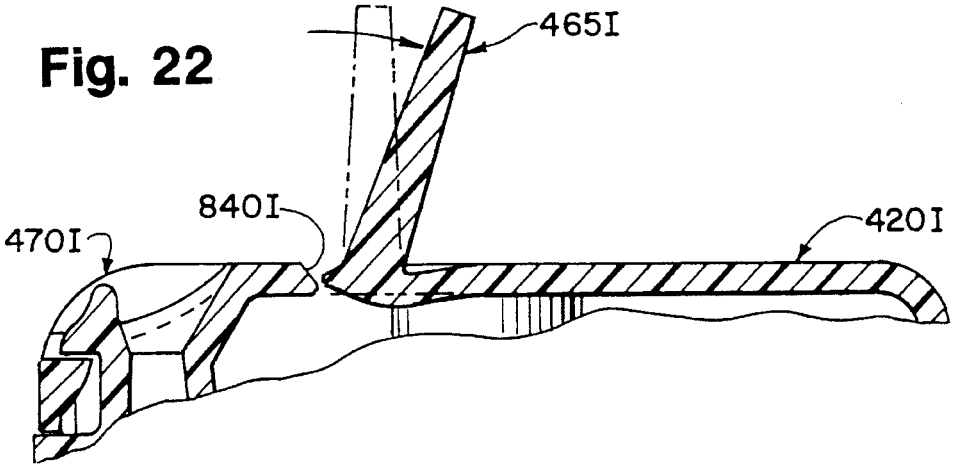
FIG. 22 is a view similar to FIG. 11, but FIG. 22 shows a thirteenth embodiment of the closure of the present invention.

FIG. 22 shows an embodiment of a closure 420I having an engaging member 465I extending upwardly from the closure lid. The top surface of the closure lid defines a stress riser in the form of a V-shaped notch 840I. The notch 840I extends transversely across the closure lid parallel to the engaging member 465I. The notch 840I has a length which is substantially equal to the width of the engaging member 465I.

If excessive force is applied to the engaging member 465I, the lid top wall breaks at the notch 840I, and this prevents the locking lever 470 from being subjected to excessive loads which might otherwise cause a deformation of the thermoplastic material at the latch region which could lead to the locking lever being overridden. Because the closure lid fractures at the notch 840I when excessive loads are applied to the engaging member 465I, the closure lid will remain latch-closed unless the locking lever 470I is first properly actuated by pushing it rearwardly.

Figure 23:
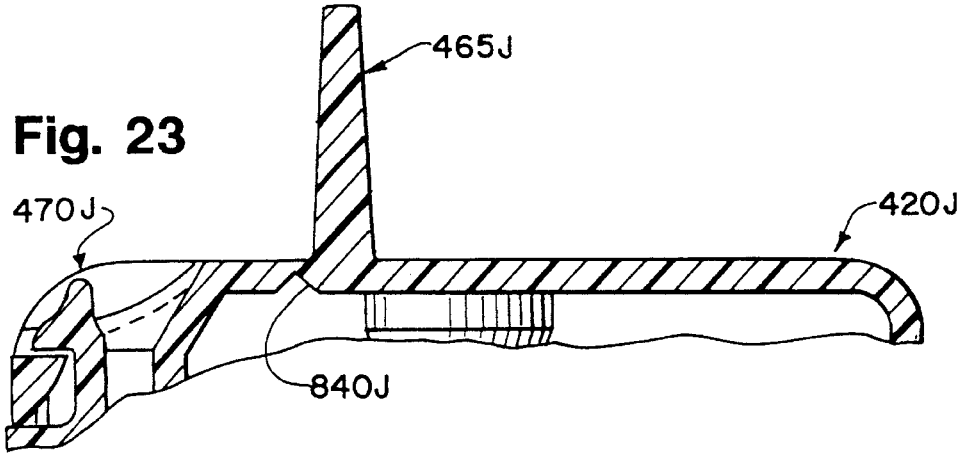
FIG. 23 is a view similar to FIG. 22, but FIG. 23 shows a fourteenth embodiment of the closure of the present invention.

FIG. 23 illustrates a closure 420J having an engaging member 465J. The member 465J extends upwardly from the closure lid which has a stress riser in the form of an inverted V-shaped notch 840J which extends transversely along the lid for a distance equal to the width of the member 465J. This creates a thinner cross-sectional wall which is substantially weaker than the surrounding uniform wall. When an excessive force is applied to the engaging member 465J in an effort to override the closed locking lever 470J, the lid wall breaks away at the notch 840J leaving the lid closed.

Figure 24:
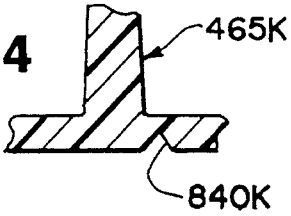
FIG. 24 is a view similar to FIG. 23, but FIG. 24 shows a fifteenth embodiment of the closure of the present invention.

FIG. 24 shows an alternate embodiment wherein the stress riser is provided as a notch 840K in the closure lid lower surface slightly rearwardly of an engaging member 465K.

Figure 25:
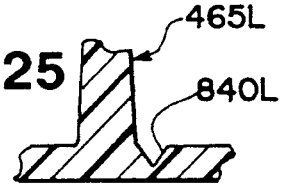
FIG. 25 is a view similar to FIG. 24, but FIG. 25 shows a sixteenth embodiment of the closure of the present invention.

FIG. 25 shows an alternate embodiment wherein a notch 840L is provided in the top surface of the closure lid behind an engaging member 465L. This will cause the lid to fracture behind the engaging member 465L when excessive force is applied to the engaging member 465L.

Figure 26:
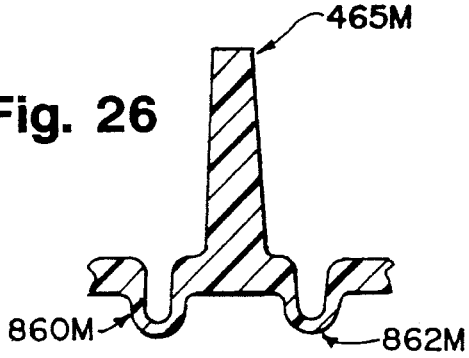
FIG. 26 is a view similar to FIG. 25, but FIG. 26 shows a seventeenth embodiment of the closure of the present invention.
Figure 27:
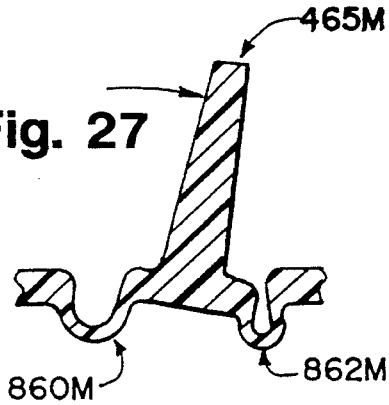
FIG. 27 is a view similar to FIG. 26, but FIG. 27 shows a moved position of the engaging member.

FIGS. 26 and 27 illustrate another way in which flexibility can be added to a closure around the engaging member. The top wall of the closure lid includes a front, U-shaped, flexible member 860M and a rear, U-shaped, flexible member 862M. An engaging member of 465M projects upwardly from the closure lid between the two, U-shaped, flexible members 860M and 862M. The flexible members permit the engaging member 865M to flex rearwardly or forwardly when an excessive force is applied to the member 465M in an attempt to override the locking lever.

FIG. 27 illustrates the position of the engaging member 465M when a force of sufficient magnitude is applied on the front surface of the member 465M. The member 465M tilts rearwardly. The load transmitted through the tilted member 465M and through the U-shaped members 860M and 862M is then less than what would be required to effect deformation of the thermoplastic material in the region of the locking lever to avoid overriding the locking lever.

The structure illustrated in FIGS. 26 and 27 may be molded from polypropylene. The U-shaped members 860M and 862M would react somewhat like spring members. In one contemplated embodiment, the top opening of each U-shaped member is approximately one-half of the depth of the U-shaped member.

If desired, a living hinge could be provided along the rear bottom edge of the engaging member 465M as indicated by the lead line 870M in FIG. 26. When the engaging member 465M is forced rearwardly, the living hinge would be in compression and the front, U-shaped member 860M would be in tension. When the force is released, the engaging member 465M would return substantially to the original, as-molded orientation.

In one contemplated embodiment employing U-shaped spring members 860M and 862M, the size of the U-shaped trough can be estimated. In particular, the length of the U-shaped trough in cross section (i.e., the sum of the lengths of the two legs plus the length of the arc at the bottom of the trough) should be about equal to the length of the arc which is defined by the distal end of the tab as the tab tilts rearwardly to a point at which a selected design limit force applied to the tab is insufficient to deform the latch and override the locking lever.

It will be appreciated that if the novel engaging member design of the present invention is incorporated in a child-resistant closure having a latching mechanism, such a latching mechanism may have other forms and operate in a different way compared to the engaging hole and latching lever described above. Such alternate designs may include rotatable mechanisms, button-type mechanisms, or other devices for holding a lid closed and which must be manipulated by the user in order to release the lid so that the lid can be subsequently lifted upwardly.

It will be readily apparent from the foregoing detailed description of the invention and from the illustrations thereof that numerous variations and modifications may be effected without departing from the true spirit and scope of the novel concepts or principles of this invention.

What is claimed is:

1. A closure for an opening to a container interior, said closure comprising:

a base for attachment to said container at said opening and defining a discharge aperture communicating with said opening;

a lid hingedly connected to said base for movement between a closed position occluding said aperture and an open position away from said aperture;

a manually releasable latch defined cooperatively by said base and lid to hold said lid closed;

said lid having an outwardly projecting engaging member whereby the user can release said latch and apply a force to said engaging member to move said lid toward said open position via said engaging member, said engaging member having a notch adjacent said lid.

2. The closure in accordance with claim 1 in which said notch faces toward the region where said lid is hingedly connected to said base.

3. The closure in accordance with claim 1 in which said engaging member has two, generally oppositely facing surfaces and in which a first notch is defined in one of said surfaces adjacent said lid and in which a second notch is defined in the other of said surfaces adjacent said lid.

4. A closure for an opening to a container interior, said closure comprising:

a base for attachment to said container at said opening and defining a discharge aperture communicating with said opening;

a lid hingedly connected to said base for movement between a closed position occluding said aperture and an open position away from said aperture;

a manually releasable latch defined cooperatively by said base and lid to hold said lid closed;

said lid having an outwardly projecting engaging member whereby the user can release said latch and apply a force to said engaging member to move said lid toward said open position via said engaging member, said engaging member defineing a notch at a location spaced above said lid.

5. A closure for an opening to a container interior, said closure comprising:

a base for attachment to said container at said opening and defining a discharge aperture communicating with said opening;

a lid hingedly connected to said base for movement between a closed position occluding said aperture and an open position away from said aperture;

a manually releasable latch defined cooperatively by said base and lid to hold said lid closed;

said lid having an outwardly projecting engaging member whereby the user can release said latch and apply a force to said engaging member to move said lid toward said open position via said engaging member, said engaging member decreasing in thickness within increasing distance from said lid.

6. A closure for an opening to a container interior, said closure comprising:

a base for attachment to said container at said opening and defining a discharge aperture communicating with said opening;

a lid hingedly connected to said base for movement between a closed position occluding said aperture and an open position away from said aperture;

a manually releasable latch defined cooperatively by said base and lid to hold said lid closed;

said lid having an outwardly projecting engaging member whereby the user can release said latch and apply a force to said engaging member to move said lid toward said open position via said engaging member, an aperture being defined in said lid adjacent said engaging member.

7. A closure for an opening to a container interior, said closure comprising:

a base for attachment to said container at said opening and defining a discharge aperture communicating with said opening;

a lid hingedly connected to said base for movement between a closed position occluding said aperture and an open position away from said aperture;

a manually releasable latch defined cooperatively by said base and lid to hold said lid closed;

said lid having an outwardly projecting engaging member whereby the user can release said latch and apply a force to said engaging member to move said lid toward said open position via said engaging member, said lid defining two apertures, one on each side of said engaging member.

8. A closure for an opening to a container interior, said closure comprising:

a base for attachment to said container at said opening and defining a discharge aperture communicating with said opening;

a lid hingedly connected to said base for movement between a closed position occluding said aperture and an open position away from said aperture;

a manually releasable latch defined cooperatively by said base and lid to hold said lid closed;

said lid having an outwardly projecting engaging member whereby the user can release said latch and apply a force to said engaging member to move said lid toward said open position via said engaging member, the exterior surface of said lid defining a V-shaped notch adjacent said engaging member.

9. A closure for an opening to a container interior, said closure comprising:

a base for attachment to said container at said opening and defining a discharge aperture communicating with said opening;

a lid hingedly connected to said base for movement between a closed position occluding said aperture and an open position away from said aperture;

a manually releasable latch defined cooperatively by said base and lid to hold said lid closed;

said lid having an outwardly projecting engaging member whereby the user can release said latch and apply a force to said engaging member to move said lid toward said open position via said engaging member, the interior surface of said lid defining an inverted V-shaped notch adjacent said engaging member.

10. A closure for an opening to a container interior, said closure comprising:

a base for attachment to said container at said opening and defining a discharge aperture communicating with said opening;

a lid hingedly connected to said base for movement between a closed position occluding said aperture and an open position away from said aperture;

a manually releasable latch defined cooperatively by said base and lid to hold said lid closed;

said lid having an outwardly projecting engaging member whereby the user can release said latch and apply a force to said engaging member to move said lid toward said open position via said engaging member, said lid defining a pair of spaced-apart U-shaped spring members, said engaging member projecting upwardly from said lid between said two spring members.

11. The closure in accordance with claim 10 in which said lid defines a living hinge adjacent one of said spring members.

12. A closure for an opening to a container interior, said closure comprising:

a base for attachment to said container at said opening and defining a discharge aperture communicating with said opening;

a lid hingedly connected to said base for movement between a closed position occluding said aperture and an open position away from said aperture;

a manually releasable latch defined cooperatively by said base and lid to hold said lid closed;

said lid having an outwardly projecting engaging member whereby the user can release said latch and apply a force to said engaging member to move said lid toward said open position via said engaging member, said lid having an exterior surface and an interior surface and defining a reduced thickness region adjacent said engaging member in at least one of said surfaces.

* * * * *